US005824404A

United States Patent [19]

Brown et al.

[11] Patent Number: 5,824,404

[45] Date of Patent: Oct. 20, 1998

[54] HYBRID COMPOSITE ARTICLES AND MISSILE COMPONENTS, AND THEIR FABRICATION

[75] Inventors: Janis Brown, Tucson, Ariz.; Ron Allred, Albuquerque, N. Mex.; Tom Duncan; Andrew Facciano, both of Tucson, Ariz.; Kevin Kirby, Calabasas Hills, Calif.

[73] Assignee: Raytheon Company, Los Angeles, Calif.

[21] Appl. No.: 488,004

[22] Filed: Jun. 7, 1995

[51] Int. Cl.[6] ..... B32B 5/06

[52] U.S. Cl. ..... 428/301.4; 428/212; 428/297.4; 428/300.7; 428/447; 428/450; 428/457; 428/417; 428/418; 442/156; 257/625; 257/675; 257/706; 257/712

[58] Field of Search ..... 428/447, 212, 428/450, 457, 417, 418, 297.4, 300.7, 301.4; 442/156; 257/625, 675, 706, 712

[56] References Cited

U.S. PATENT DOCUMENTS

| | | | |
|---|---|---|---|
| 4,041,872 | 8/1977 | McCown et al. . | |
| 4,341,965 | 7/1982 | Okuo et al. | 428/698 |
| 4,961,989 | 10/1990 | Grimwood | 428/447 |
| 5,552,466 | 9/1996 | Beckley et al. | 524/265 |

FOREIGN PATENT DOCUMENTS

| | | |
|---|---|---|
| 0 419 338 A | 9/1990 | European Pat. Off. . |
| 33 25 034A | 1/1985 | Germany . |
| 63-290732 | 11/1988 | Japan . |
| 1-252590 | 10/1989 | Japan . |
| 2205859 | 12/1988 | United Kingdom . |

OTHER PUBLICATIONS

FR 2 681 940 A (Rheinmetall GmbH) * the whole document* Sep. 1992.

R. Baney: "Preceramic polymers" 1990, Wiley X P000577869 *p. 899–p. 902*.

D. Wilson: "Development of silicone matrix–based advanced composites for thermal protection" 1994, Institute of Physics, UK X P000576982 *p. 165–p. 181*.

D. Wilson: "Development of new materials for missile lauch structures" Nov. 1993, CPIA, US XP000577431 *p. 175–p. 184*.

*Primary Examiner*—Archene Turner

*Attorney, Agent, or Firm*—Brian C. Downs; Leonard A. Alkov; Glenn H. Lenzen, Jr.

[57] ABSTRACT

A surface-protected composite article, such as a missile component, is prepared with a heat-sink substrate, a first composite layer of an pre-ceramic-matrix structural composite material, and a second composite layer of a reinforced silicone pre-ceramic material. The silicone material is co-curable with the organic matrix of the first composite layer. The silicone at the surface of the article is thereafter converted to a silica refractory by an appropriate treatment such as exposure to an oxygen-rich plasma or a high-surface temperature. The silica protects the surface of the composite material.

11 Claims, 4 Drawing Sheets

HYBRID COMPOSITE ARTICLES AND MISSILE COMPONENTS, AND THEIR FABRICATION

BACKGROUND OF THE INVENTION

This invention relates to composite structures and their preparation, and, more particularly, to a composite structure useful in hypersonic missiles that must withstand high aerothermal temperatures for a short period of time.

Some types of short-range missiles fly at several times the speed of sound and carry enough fuel to fly at most for a few minutes. The structural components of such missiles must withstand high mechanical loadings, surface abrasion and impact damage, and chemical attack over a wide skin temperature range of ambient temperature at launch to over 2000° F. during flight. The structures must also protect the sensitive electronic and other devices located within the missile from the heat generated by skin friction as the missile flies.

The materials and structural configurations of the airframe are selected to function under the most extreme of these conditions, which are usually those encountered at the highest temperatures. Structural materials for use at high temperatures include metals such as steel and nickel alloys, ceramics, and some types of composites. Special types of structures such as honeycombs made from these materials are employed where appropriate. Additionally, ablative thermal protective systems can be used in some instances.

Each of these existing structural and protective approaches has drawbacks. The metallic alloys and ablative systems are heavy in relation to the structural strength and stiffness they provide. Ceramics tend to crack and fail prematurely. The available high-temperature organic-matrix composites provide marginal capability, while utilizing exotic organic compounds and processing which are potentially hazardous to human health. Most of these approaches are expensive to implement. Moreover, with the exception of ablative systems, the available structural techniques often provide more capability that is required for the short-range missile. The use of a nickel-alloy structural element, for example, typically provides high-temperature capability sufficient for hours of exposure, not just the few minutes of exposure required for the missile application.

There is a need for an improved approach to the materials and structures used in short-range, hypersonic missiles and other devices operating for relatively short periods of time in extreme-temperature and hostile environments. The present invention fulfills this need, and further provides related advantages.

SUMMARY OF THE INVENTION

The present invention provides a missile, missile components, and other articles having a hybrid composite structure that is suitable for short-term use in environments where the external skin temperature rises rapidly to 2000° F. or more. The approach provides excellent structural strengths with high strength-to-weight ratios. Additionally, the structure is protected against surface damage by erosion, impact of objects in the air, and chemical attack by a surface protective layer that is formed in-situ. The invention provides a basic materials design configuration which can be adapted for use in a wide range of structural applications. The materials and processing of the preferred approach involve no hazardous or dangerous chemicals.

In accordance with the invention, a composite article comprises a substrate, a first composite layer overlying and bonded to the substrate, and a second composite layer overlying and bonded to the first composite layer. The substrate is typically a metallic heat sink, and may include a further layer to protect against corrosion, such as a galvanic corrosion insulation layer. The first composite layer comprises a first-layer reinforcement embedded in a first-layer organic matrix material. The second composite layer comprises at least in part a second-layer reinforcement embedded in a second-layer pre-ceramic matrix material. The second-layer pre-ceramic matrix material is an organic composition which is co-curable with the first-layer organic matrix material and which can be converted to a refractory material with an appropriate treatment.

In a preferred approach, the first-layer reinforcement is graphite fiber, and the first-layer organic matrix material is an epoxy or a bismaleimide. The second-layer reinforcement is glass or quartz fiber, and the second-layer pre-ceramic matrix is an thermally insulative silicone material, such as a polysiloxane, which chemically converts to a silica-based refractory material when given the appropriate surface treatment or heated to an elevated temperature. A most preferred polysiloxane is polydimethylsiloxane. The first-layer organic material and the second-layer silicone both cure in the same temperature range of about 350°–450° F., allowing convenient fabrication of the structure. When such a composite structure is thereafter subjected to an oxidizing plasma treatment at moderate temperature or to a high skin temperature at the exposed surface of the second composite layer, either during fabrication or during service, the silicone pre-ceramic material at and near the surface converts to silica. The surface silica protects the surface and underlying layers against erosion, impact damage, and chemical attack.

The underlying substrate acts to control heat flow relative to, and consequently the temperature increase in, the first composite layer. Heat diffusing through the silica/silicone layer heats the first composite layer through its outer surface. The metallic heat sink contacting the inner surface of the first composite layer absorbs heat and reduces the heat buildup in the first composite layer by conducting the heat away from the first composite layer, helping to maintain it within its specified operating temperature limit during the short service life of the structure. The primary structural load-carrying capability is provided by the first composite layer, but some strengthening may be contributed by the substrate and the second composite layer as well.

This hybrid composite material is particularly useful in manufacturing structural components for short-range, hypersonic missiles. The structure is light in weight but strong. It resists degradation resulting from aerothermal temperature increases for a period of time due to the insulating effects of the silicone, which is protected by the silica formed in-situ at the surface. This protective system is effective for the required short period of time of seconds to a few minutes that is the service lifetime of the missile. The approach also has the advantage of being self repairing in the sense that, if the silica outer layer is scratched or abraded away during service, the high surface temperatures cause additional silicone to convert to silica to replenish the insulating layer.

The present invention thus provides an advance in the thermal and mechanical protection of lightweight structures, particularly transiently heated structures. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
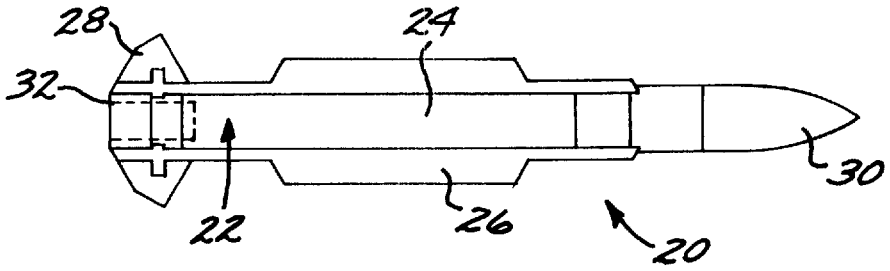
FIG. 1 is a schematic perspective view of a short-range missile.

FIG. 1 depicts a missile 20, in this case the medium-range version of the Standard missile, incorporating the approach of the present invention. The missile 20 includes an airframe 22 having several component parts with which the present invention may be used, including, for example, a fuselage 24, fixed (or foldable) wings 26, movable control surfaces 28, and a radome 30. An engine 32 is mounted within the fuselage 24 at its aft end. The present invention may be used in conjunction with other types of structures, but the missile application is preferred by the inventors.

Figure 2:
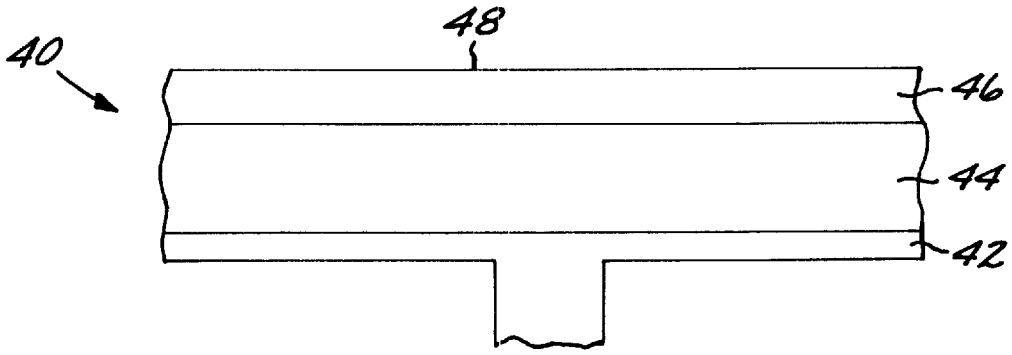
FIG. 2 is a sectional fragmentary view of one embodiment of a hybrid composite article fabricated according to the present invention, prior to surface heating.

FIG. 2 is one embodiment of a hybrid composite article 40 in a sectional view which illustrates the structural approach of the invention. The article 40 includes a substrate 42. In the embodiment of FIG. 2, the substrate is a metallic member such as a steel, nickel alloy, or aluminum alloy web section. The substrate 42 performs two principal roles in the article 40, heat sinking and structural support. A first composite layer 44 overlies and is bonded to the substrate 42. The first composite layer comprises one or more sublayers (termed "plies" before curing) of a structural composite material. The structural composite material is formed of a first-layer reinforcement material embedded in a first-layer organic matrix material. A preferred first-layer reinforcement material is graphite fibers and a preferred first-layer matrix material is either epoxy or bismaleimide. The first composite layer 44 provides the principal structural member and strength for the article 40.

A second composite layer 46 overlies and is bonded to the first composite layer 44. The second composite layer 46 comprises one or more sublayers (termed "plies" before curing) of a composite material. The composite material of the second composite layer 46 is formed of a second-layer reinforcement material embedded in a second-layer pre-ceramic matrix material. A preferred second-layer reinforcement material is glass or quartz fibers.

The second-layer pre-ceramic matrix material is an organic composition which can be utilized as the matrix of a composite material, incorporated into the matrix by standard pre-preg manufacturing techniques, and used to build structures by collating and curing techniques. The matrix is co-curable with the first-layer organic matrix material. "Co-curable" here means that the curing cycles of the first-layer organic matrix material and the second-layer pre-ceramic matrix material are compatible in the sense that they can be effected concurrently. The present invention would not be operable in a case where the curing cycles of two proposed first-layer and second-layer pre-ceramic materials were completely incompatible—such as, for example, where the curing required for one of the organic materials would damage or destroy the other of the organic materials.

The second-layer pre-ceramic matrix material must also be capable of conversion to a refractory material by the appropriate surface treatment procedure. A number of such pre-ceramic materials which can be cured according to a curing cycle and later converted to a refractory material are known in the art. See, for example, R. Baney and G. Chandra, "Preceramic Polymers", in Concise Encyclopedia of Polymer Science and Engineering, Wiley Interscience, 1990. A preferred pre-ceramic material used in the present approach is a silicone polymer which is a precursor for a silica-based refractory material. The preferred silicone polymer is a polyorganosiloxane, most preferably polydimethylsiloxane. This material is available commercially from BP Chemicals, Inc., Santa Ana, Calif., as SM8000 material. The silicone polymer forms a three-dimensional molecular structure upon curing. At higher temperatures, the silicone decomposes with the evolution of volatiles and leaves a silica ($SiO_2$) network. Such materials and their conversion from silicones to silicas are known in the art, and are described in greater detail, for example, in Doug Wilson et al., "Development of Silicone Matrix Based Advanced Composites for Thermal Protection", *High Performance Polymers*, Vol. 3, pages 165–181 (1994) and Doug Wilson et al., "Development of New Materials for Missile Launch Structures", 1993 JANNAF Propulsion Meeting, Vol. 1, CPIA Publication 602, pages 175–184 (November 1993).

Figure 3:
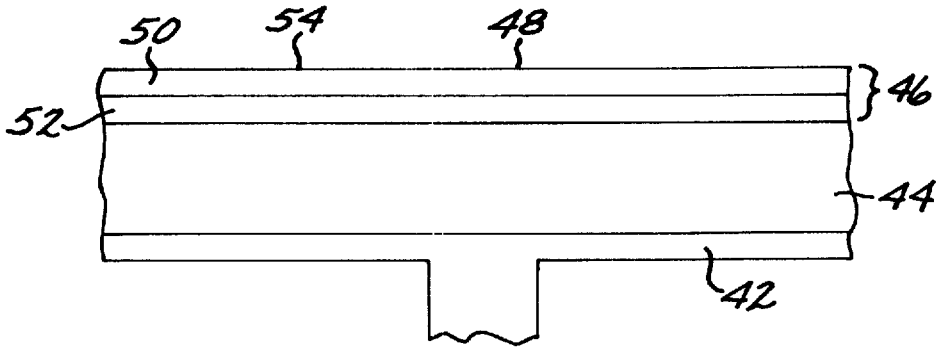
FIG. 3 is a sectional fragmentary view of the hybrid composite article of FIG. 2, after surface heating to effect conversion in-situ conversion of silicone to silica.

FIG. 3 illustrates the effect of subjecting (after curing is complete) an outwardly facing, external surface 48 of the second composite layer 46 of the article 40 to a treatment to effect the conversion of the silicone to the silica. As will be discussed subsequently, this conversion can be conducted either during the fabrication operation or during the service of the composite structure where high surface temperatures result from the service. The silicone in the portion of the second composite layer 46 immediately adjacent to the external surface 48 is converted to the silica form to yield a top layer 50 contacting the remaining unconverted portion 52 of the second composite layer 46. The top layer 50 thus comprises a composite material of the second-layer reinforcement in a matrix of silica. However, immediately adjacent to the external surface 48 there may be no second-layer reinforcement at all, so the top layer may have a surface region 54 of unreinforced silica. The top layer 50 need only be a few micrometers thick to have a beneficial effect on the properties of the structure, but it can be thicker if desired.

Whatever the details of the structure of the top layer 50, the silica present in the top layer is substantially harder, more erosion resistant, more impact resistant, and more corrosion resistant than the silicone precursor which formed that same portion of the structure prior to conversion. The near-surface silica-containing region thus acts to resist erosion, impact, and corrosion more effectively than the precursor silicone from which it was formed. This top-layer region 50 is self-repairing in the sense that if the top layer 50 is partially or completely removed by scratching, erosion, or the like, the silicone in the unconverted portion 52 will spontaneously convert to the silica form to reestablish the protection of the underlying structure.

Figure 4:
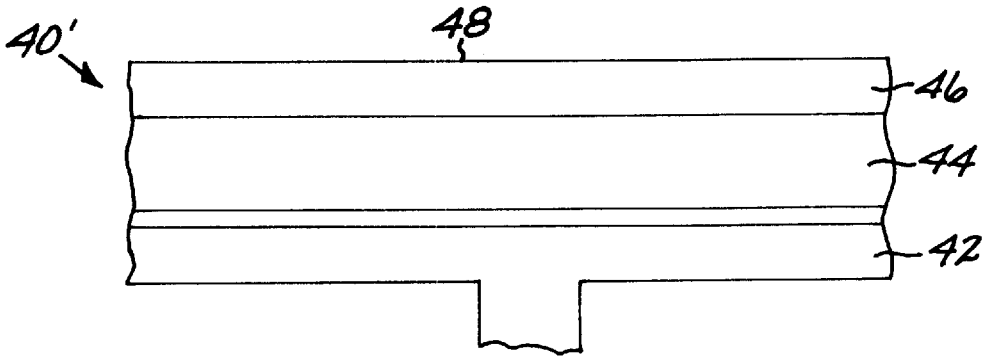
FIG. 4 is a sectional fragmentary view of another embodiment of the hybrid composite article fabricated according to the present invention, prior to surface heating.

FIG. 4 illustrates another embodiment of the article, denoted 40', wherein most of the structural elements are the same as shown in FIG. 2 and are correspondingly numbered. In the embodiment 40', however, a corrosion-resistant layer 55 is placed between the substrate 42 and the first composite layer 44. The corrosion-resistant layer 55 is, in one form, an insulator such as a composite of glass reinforcement in an epoxy or bismaleimide matrix. This embodiment is useful when a device is attached to an inside surface of the substrate 42, as will be discussed in relation to a specific structure subsequently.

Figure 5:
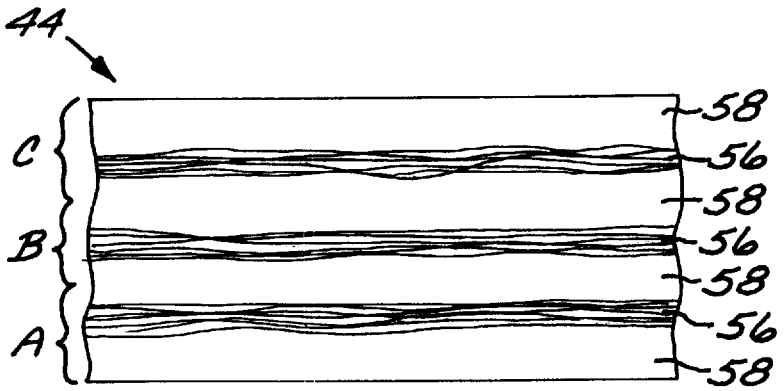
FIG. 5 is an enlarged view of the first composite layer of the articles of FIGS. 2 or 4.

An example of the first composite material of the first layer 44 is illustrated in FIG. 5. The composite material is formed of mats of woven or unwoven fibers 56 into which the matrix material 58 has been impregnated and from which the matrix material 58 extends slightly. These mats and matrix material, termed prepregs before collation and curing, are available commercially for a number of materials types and can be prepared on a custom basis as need, by known manufacturing technologies. FIG. 5 illustrates three plies A, B, and C of composite prepreg which have been stacked together and cured in the co-curing processing. The first composite layer 44 is the primary structural member of the article 40 in the preferred approach, and consequently the number and arrangement of the plies can be varied as established by conventional structural analysis of the particular application.

Figure 6:
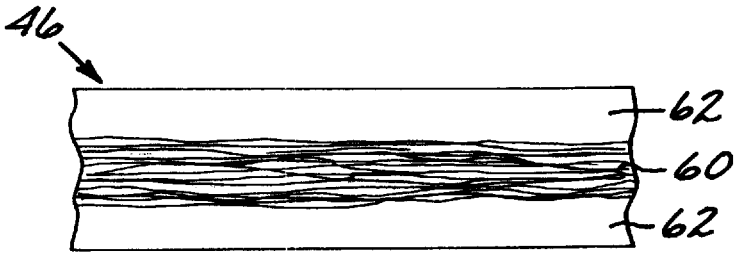
FIG. 6 is an enlarged view of the second composite layer of the articles of FIGS. 2 or 4.

Similarly, FIG. 6 shows the structure of the second composite layer 46 formed of mats of woven or unwoven fibers 60 into which the pre-ceramic matrix material 62 has been impregnated and from which the matrix material 62 extends slightly on either side. In this case, only a single ply is shown, but there could be more plies as desired for a greater thickness of the silicone/silica material.

The layers 44, 46, and 55 are preferably made as composite materials. A virtue of this approach is that these layers can be made from many different types of reinforcements and matrix materials, within the constraints discussed herein.

Figure 7:
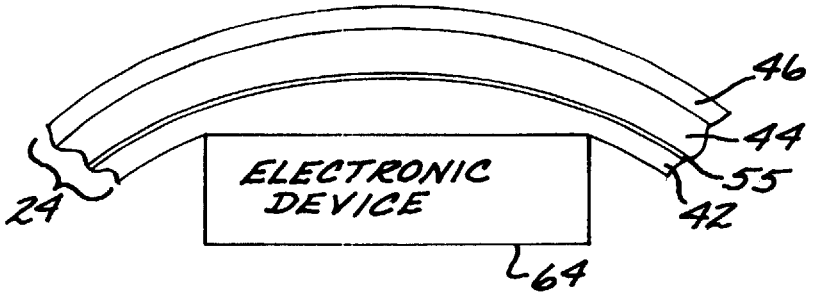
FIG. 7 is a sectional fragmentary view of a missile fuselage fabricated according to the present invention.
Figure 8:
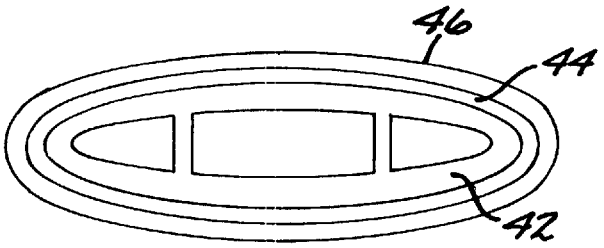
FIG. 8 is a sectional view of a missile fixed wing fabricated according to the present invention.

FIGS. 7 and 8 illustrate two specific structural components of the missile 20 made according to the present approach. As shown in FIG. 7, a portion of the fuselage 24 is made from a structure of metallic substrate 42, insulating layer 55, first composite layer 44, and second composite layer 46. An electronic device 64 is affixed to the metallic substrate 42. The substrate 42 thus acts as a heat sink for the first-composite layer 44 and for the electronic device 64, as needed, during the short service life of the missile.

Referring to FIG. 8, the wing 26 is made from a metallic substrate 42 forming the central beam of the wing, with the first composite layer 44 overlying and bonded to the metallic substrate 42, and the second composite layer 46 overlying and bonded to the first composite layer 44. The control surface 28 has substantially the same structure, differing only in that the control surface 28 is movable and the wing 26 is fixed.

The use of the present invention is not limited to applications on a missile or to the specific structural components illustrated in FIGS. 1, 7, and 8. For example, a control section housing with an integral, interiorly facing, blast-tube nozzle can be made with the present approach. In this application, the aft control section of the missile is made of the structure described herein, with a generally hollow cylindrical metallic substrate structure, the first composite layer within the metallic substrate structure, and the second composite layer within the first composite layer. The first composite layer forms the liner of the blast tube for the engine of the missile.

Figure 9:
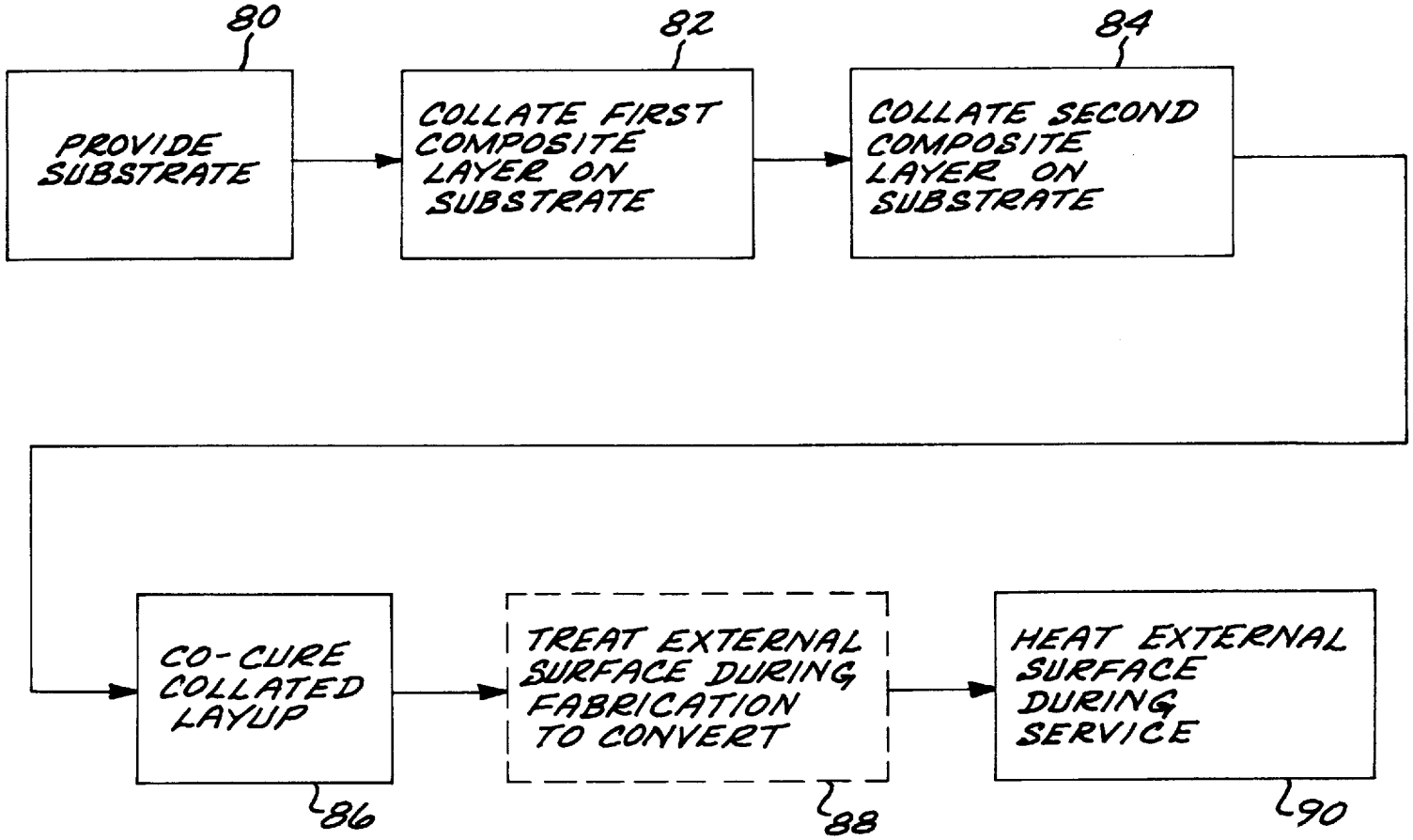
FIG. 9 is a block diagram of a fabrication method for a composite structural component.

FIG. 9 illustrates a preferred method for practicing the approach of the invention. The substrate 42 is provided, numeral 80. The first composite layer 44 is collated (i.e., laid up or arranged) on the substrate 42, numeral 82. (If a layer 55 is used, it is collated onto the substrate 42 prior to the first composite layer 44.) The second composite layer 46 is collated on the first composite layer 44, numeral 84. The use of the pre-ceramic material as the matrix of the second composite layer 46 permits such a fabrication approach, because refractories such as silica are hard and brittle, and cannot be formed in this manner. As discussed earlier, any or all of the layers 44, 46, and 55 may consist of multiple plies (i.e., sublayers) of the same or different materials, selected within the constraints discussed herein. The plies are individually collated onto the preceding collated elements in a serial manner to build up the composite structure, in the manner well known in the art of fabrication of composite structures by collating and curing procedures.

The collated assembly of elements 42, 44, 55 if present, and 46 is co-cured, numeral 86 in any operable manner. Typically, the elements are placed inside a rubber bladder, sometimes termed a vacuum bag, and a pressure is applied externally or a vacuum is drawn internally. The assembly is placed into a furnace and heated through a curing cycle of temperature and time steps that have been established operable to co-cure the composite matrix materials. These steps are known for the various types of matrix materials. The resulting structure may be post-cured as specified.

Figure 10:
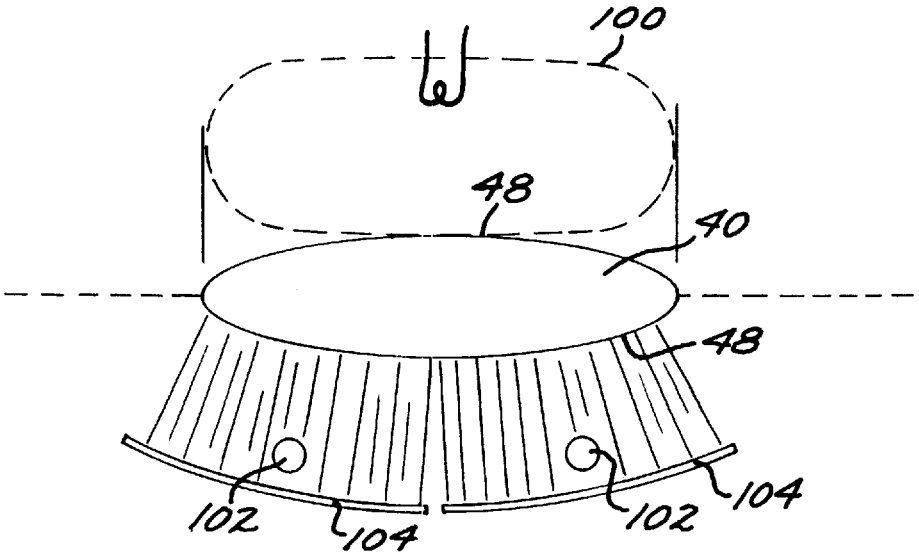
FIG. 10 is a schematic diagram illustrating two approaches for surface heating of the composite structural component during fabrication.

The resulting structure is a free-standing element that may be used directly as a structural component. Preferably, however, the outwardly facing, external surface 48 is first treated, numeral 88, to effect the pre-ceramic-to-refractory conversion, which is the silicone-to-silica conversion in the preferred case. (As used herein, "outwardly facing" is referenced relative to the three-component arrangement of substrate/first composite layer/second composite layer. The outwardly facing surface may also face outwardly relative to the entire missile structure, as in the case of the fuselage or the wing, or it may face inwardly relative to the entire missile structure, as in the case of the control section housing with integral blast tube nozzle.) In the preferred approach, the external surface 48 is contacted to an oxygen-rich glow discharge plasma 100 at a temperature of 200°–400° F., as shown in FIG. 10. This approach is preferred because the underlying structure is not unduly heated. The effect of the plasma is to convert the silicone to a quasi-ceramic form or directly to silica, to a depth which depends upon the time of exposure but is typically in the range of several micrometers.

Alternatively, the external surface 48 may be locally heated to a temperature above that reached in co-curing 86 and sufficient to accomplish the pre-ceramic-to-refractory conversion. In the case of the silicone-to-silica conversion that is the preferred embodiment, the surface temperature must reach about 1200°–1600° F. for a period of several seconds. External surface heating can be accomplished in any operable manner, and one such approaches are illustrated in FIG. 10. The surface 48 of the article 40 is heated by a surface heating source 102 such as quartz heat lamps with reflectors 104 to produce an even heating field. Equivalently, surface heating can be produced by a defocussed laser beam directed against the surface 48. FIG. 10 illustrates two surface treatment approaches in one figure for convenience, but normally one of the heating approaches would be selected for all surfaces of the article 40. The conversion treatment 88 should not, however, utilize general heating of the entire cured structure, as distinct from plasma treating or preferential heating of the surface of the structure, because such high temperatures can damage the first composite layer 44 and the substrate 42.

The article 40 is thereafter heated on its external surface 48 during service, numeral 90. The service heating 90 can be relied upon to effect the silicone-to-silica conversion. That is, the fabrication treating step 88 can be omitted, as indicated by the dashed form of the block 88 in FIG. 9, but it is preferably not omitted for several reasons. The use of the fabrication treating step 88 provides a controlled treatment to produce a known physical state, without the uncertainties inherent in reliance upon in-service heating. This known physical state ensures erosion resistance and the other benefits of the silica layer will be available immediately upon launch of the missile. It is preferred to paint the missile prior to the completion of fabrication for surface protection, and it is more difficult to paint a silicone surface than a silica surface.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A composite article, comprising:

a substrate;

a first composite layer overlying and bonded to the substrate, the first composite layer comprising a first-layer reinforcement embedded in a first-layer organic matrix material; and a second composite layer overlying and bonded to the first composite layer, the second composite layer comprising at least in part a second-layer reinforcement embedded in a second-layer pre-ceramic matrix material, the second-layer pre-ceramic matrix material being a material which is co-curable with the first-layer organic matrix material and which is convertible to a refractory material.

2. The composite article of claim 1, wherein the structural component further comprises a top layer of the second layer reinforcement embedded in the refractory material matrix, the top layer being bonded to the second composite layer.

3. The composite article of claim 1, wherein the substrate is selected from the group consisting of a metallic heat sink, a nonmetallic insulator, and a metallic heat sink with a nonmetallic insulator bonded thereto.

4. The composite article of claim 1, wherein the first-layer organic matrix material is selected from the group consisting of an epoxy and a bismaleimide.

5. The composite article of claim 1, wherein the second-layer pre-ceramic matrix material is a silicone material which converts to a silica-based refractory material at an elevated temperature.

6. The composite article of claim 1, wherein the second-layer pre-ceramic matrix material is a polysiloxane.

7. The composite article of claim 1, wherein the substrate is a metal.

8. The composite article of claim 7, further including an electronic device affixed to the metallic substrate on a side remote from the first composite layer.

9. The composite article of claim 1, wherein the substrate is selected from the group consisting of steel, nickel alloy, and aluminum alloy web section.

10. The composite article of claim 1, further including:

an additional layer disposed between the substrate and the first composite layer, wherein the additional layer is made of a material selected from the group consisting of a corrosion-resistant material and a thermal-insulator material.

11. The composite article of claim 10, wherein the additional layer comprises a composite of glass reinforcement in an organic matrix.

* * * * *